US009027177B2

(12) United States Patent
Perez

(10) Patent No.: US 9,027,177 B2
(45) Date of Patent: May 12, 2015

(54) SHOWER DOOR ASSEMBLY WITH AN INTEGRAL DIRECTIONAL DRAINING SYSTEM

(76) Inventor: Edwin Perez, Davie, FL (US)

( * ) Notice: Subject to any disclaimer, the term of this patent is extended or adjusted under 35 U.S.C. 154(b) by 581 days.

(21) Appl. No.: 13/436,251

(22) Filed: Mar. 30, 2012

(65) Prior Publication Data

US 2013/0254984 A1 Oct. 3, 2013

(51) Int. Cl.
*A47K 3/34* (2006.01)
*A47K 3/36* (2006.01)
*A47K 3/30* (2006.01)

(52) U.S. Cl.
CPC .... *A47K 3/36* (2013.01); *A47K 3/30* (2013.01)

(58) Field of Classification Search
CPC .... A47K 3/302; A47K 3/36; A47K 2003/305
USPC ..... 4/557, 607, 609, 610
See application file for complete search history.

(56) References Cited

U.S. PATENT DOCUMENTS 3,449,770 A * 6/1969 Casebolt ..... 4/607
6,035,460 A * 3/2000 Borter ..... 4/607

* cited by examiner

*Primary Examiner* — Tuan N Nguyen
(74) *Attorney, Agent, or Firm* — Craig Kirsch

(57) ABSTRACT

A shower door assembly with an integral directional draining system including a shower door frame having a frame body defining a horizontal drain channel and a plurality of drain holes, at least one side panel having a first end and a second end, the first end of the side panel being sized and configured to be fixedly attached to the frame body and the second end of the side panel further including a hinge mount, and at least one door defining a hinge mount rotatably connected to the hinge mount of the side panel and a door drain channel, the door having an upper portion and lower portion. The door of the present invention flares upward and bows outward such that the upper portion of the door is farther away from the shower door frame than the lower portion of the door.

8 Claims, 9 Drawing Sheets

Fig. 7
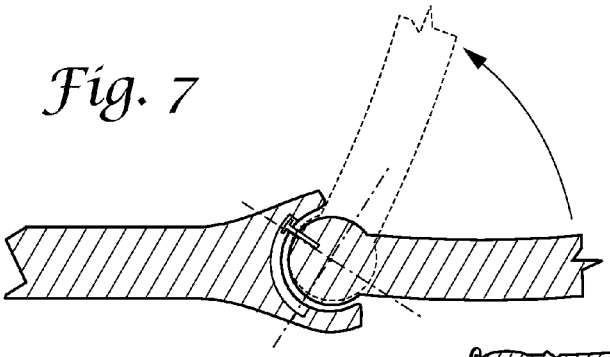
Fig. 8A
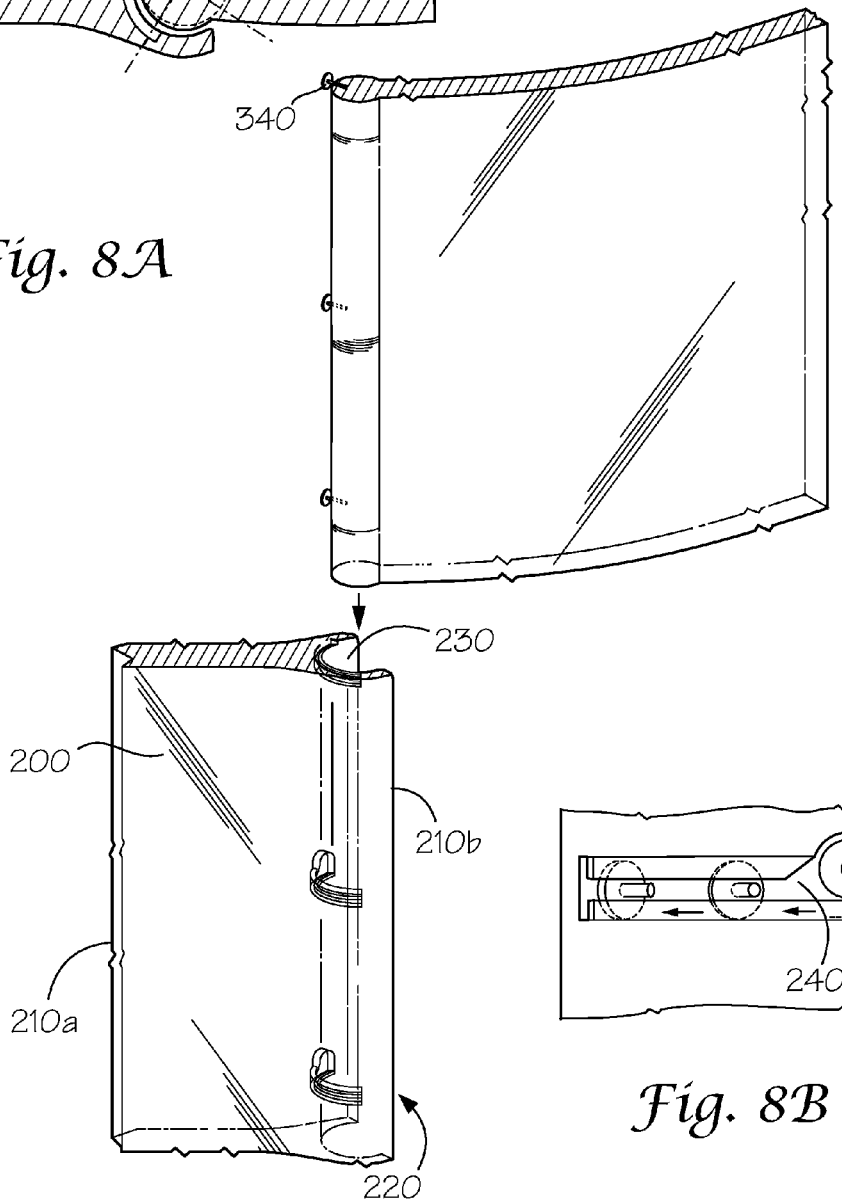
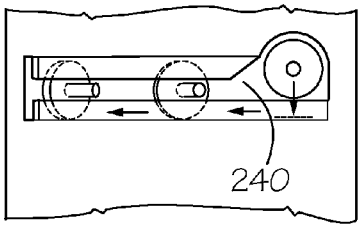
Fig. 8B

SHOWER DOOR ASSEMBLY WITH AN INTEGRAL DIRECTIONAL DRAINING SYSTEM

BACKGROUND

The present invention relates to shower door assemblies, specifically shower door assemblies with integral directional draining systems.

The inventor conceived of the present invention while engaging in his daily bathing routine and realizing that regardless how hard he tried, there was always a certain amount of water that ended up on the floor in front of his bath tub when a conventional shower curtain was used.

The traditional shower curtain that falls straight down from the mounting rod, not only fails to prevent water from trickling down the outside of the bathtub onto the bathroom floor, but it also creates a very small bathing area that can be uncomfortable for larger individuals or persons that are not comfortable in small confined spaces.

In addition to the discomfort of the confined space, the water on the bathroom floor creates a danger in the bathroom. The National Safety Council has reported that on average 640 people a day are injured in the bathroom and that approximately 65% of those injuries occur in or near tubs or showers.

The inventor realized that he could create a safer, more comfortable bathing experience by modifying a shower door assembly to include a directional draining system and a flared and bowed shape in order to give the bather more room inside the shower while keeping the bathroom floor safe and dry.

An objective of the present invention is to provide a shower door assembly with an integral directional draining system that directs shower water into the interior of a bathtub or shower.

Another objective of the present invention is to provide a shower door assembly that increases the interior bathing area of a bathtub or shower.

Another objective of the present invention is to provide a shower door assembly that forms a water tight seal when the door is in a closed position.

Yet another objective of the present invention is to provide a shower door assembly that includes a mechanism to keep the door in a closed position.

For the foregoing reasons, there is a need for a shower door assembly with an integral directional draining system.

SUMMARY

The present invention is directed to a shower door assembly with an integral directional draining system.

The shower door assembly comprises of a shower door frame comprising of a frame body defining a horizontal drain channel and a plurality of drain holes, at least one side panel comprising of a first end and a second end, the first end of the side panel being sized and configured to be fixedly attached to the frame body and the second end of the side panel further comprising of a hinge mount, and at least one door defining a hinge mount rotatably connected to the hinge mount of the side panel and a door drain channel, the door comprising of an upper portion and lower portion. The door of the present invention flares upward and bows outward such that the upper portion of the door is farther away from the shower door frame than the lower portion of the door. The door is secured in a closed position using earth magnets and a sealing gasket. When the door is an open position, any water beads running down the length of the door are directed to the horizontal drain channel of the shower door frame from the door drain channel and thereby preventing water from dripping on the bathroom floor and causing a hazard. The flared and bowed design of the shower door creates a larger bathing area for the bather, thereby giving the bather more space to move about and limiting the likelihood of a bathtub accident from occurring.

In another embodiment of the invention, the shower door is slidably mounted in the shower door frame and secured in a closed position using earth magnets and a sealing gasket.

In still another embodiment of the invention, the shower door is rotatably mounted to the shower door frame and secured in a closed position using earth magnets and a sealing gasket.

The present invention addresses the need of expanding the confined bathing area typically associated with traditional showers while also preventing water from dripping on the bathroom floor, thereby creating an all-around safer and more comfortable bathing experience.

DRAWINGS

These and other features, aspects, and advantages of the present invention will become better understood with regard to the following description, appended claims and drawings where:

FIG. 7 shows a detailed depiction of the range of motion of the door hinge assembly;

FIG. 8A shows an exploded view of the hinge assembly comprising the hinge mount of the side panel and the mounting head of the door;

FIG. 8B shows a detailed view of the mounting head of the door engaged with the horizontal door mounting channel of the side panel;

DESCRIPTION

Figure 1:
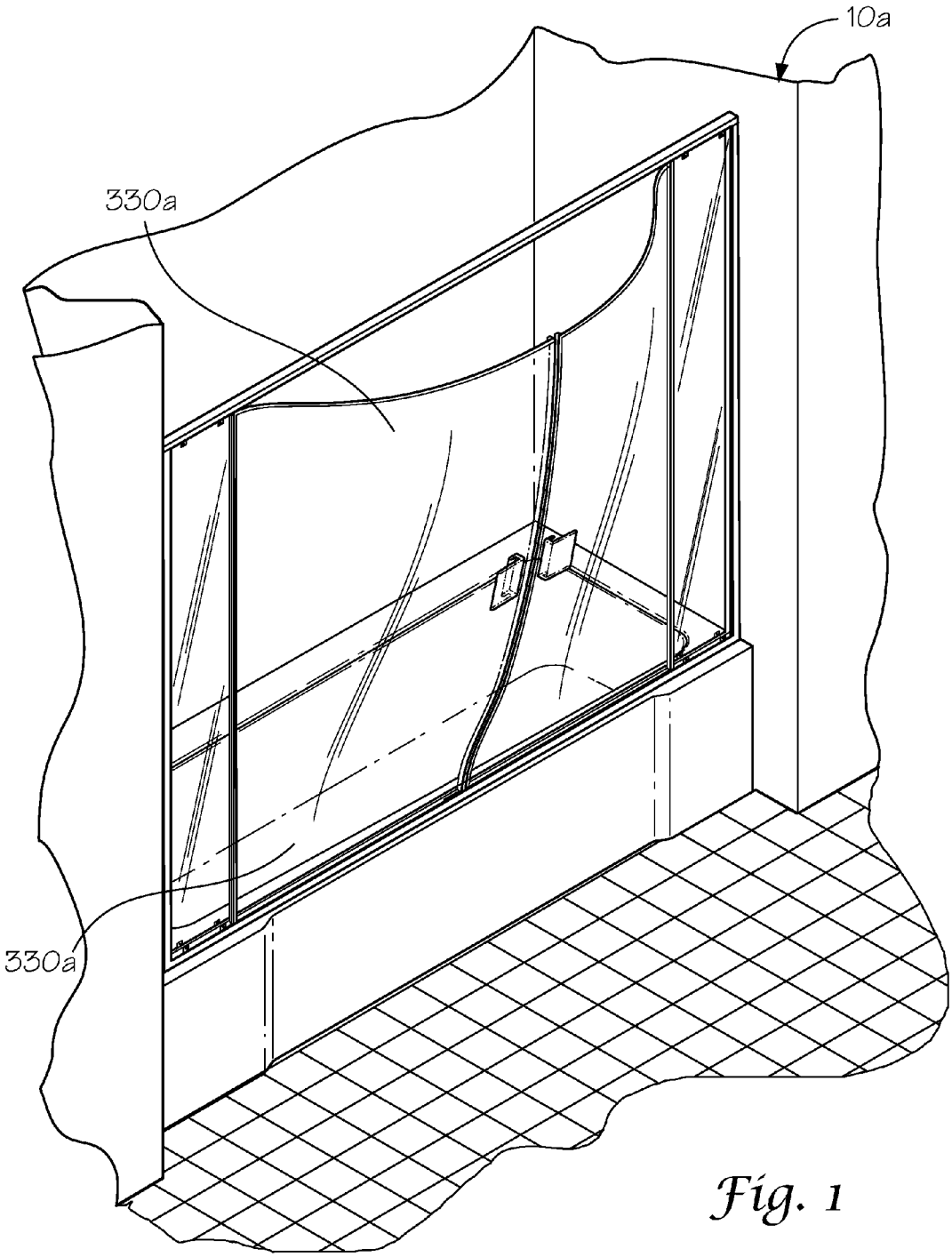
FIG. 1 shows a perspective view of one embodiment of the present invention with two hingedly mounted doors in the closed position.
Figure 2:
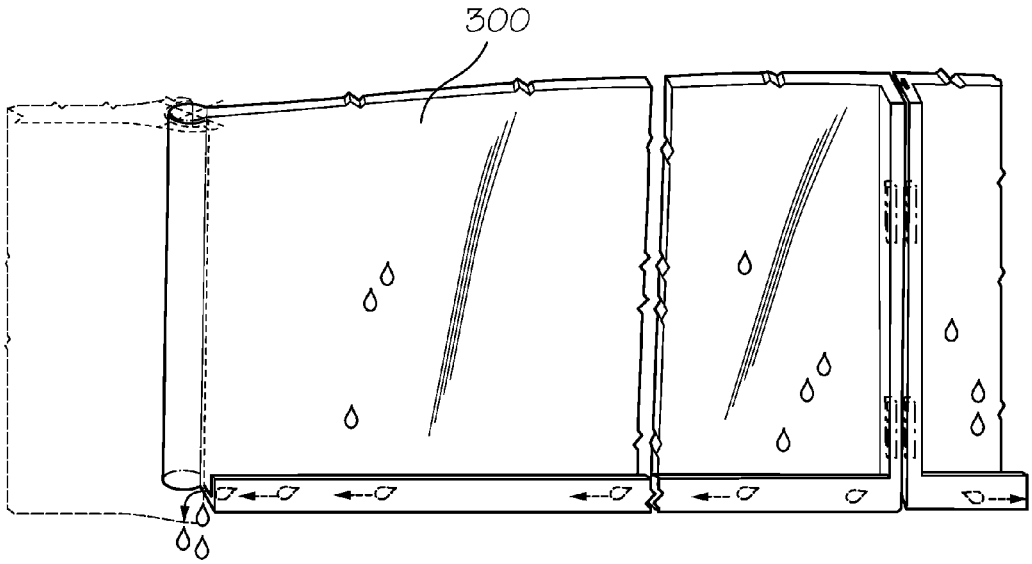
FIG. 2 shows a cut away view of the bottom portion of the door drain channel directing the flow of water when the doors are held in the closed position using earth magnets.
Figure 3:
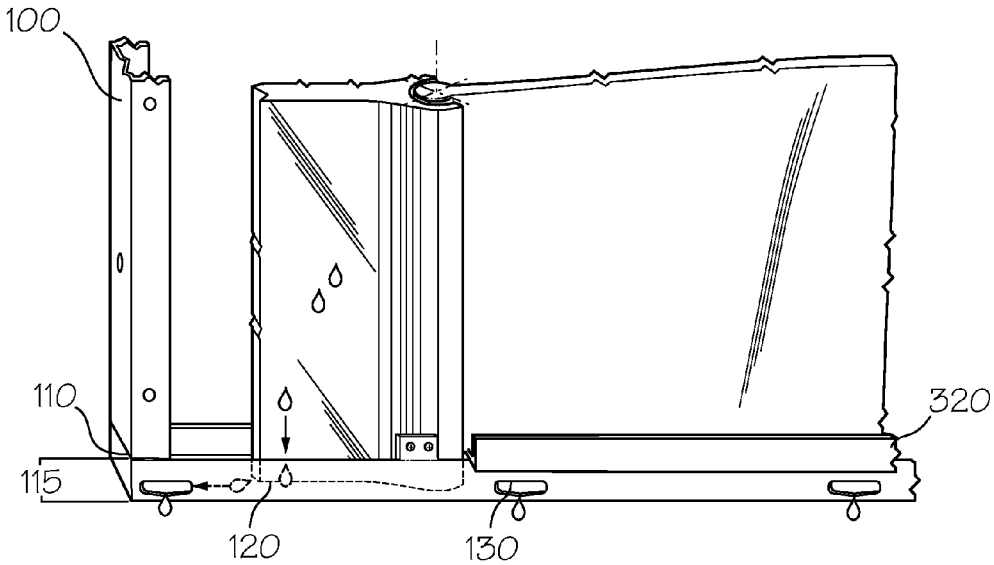
FIG. 3 shows a cut away view of the bottom portion of the door drain channel directing the flow of water from the door drain channel to the drains of the door frame.
Figure 4:
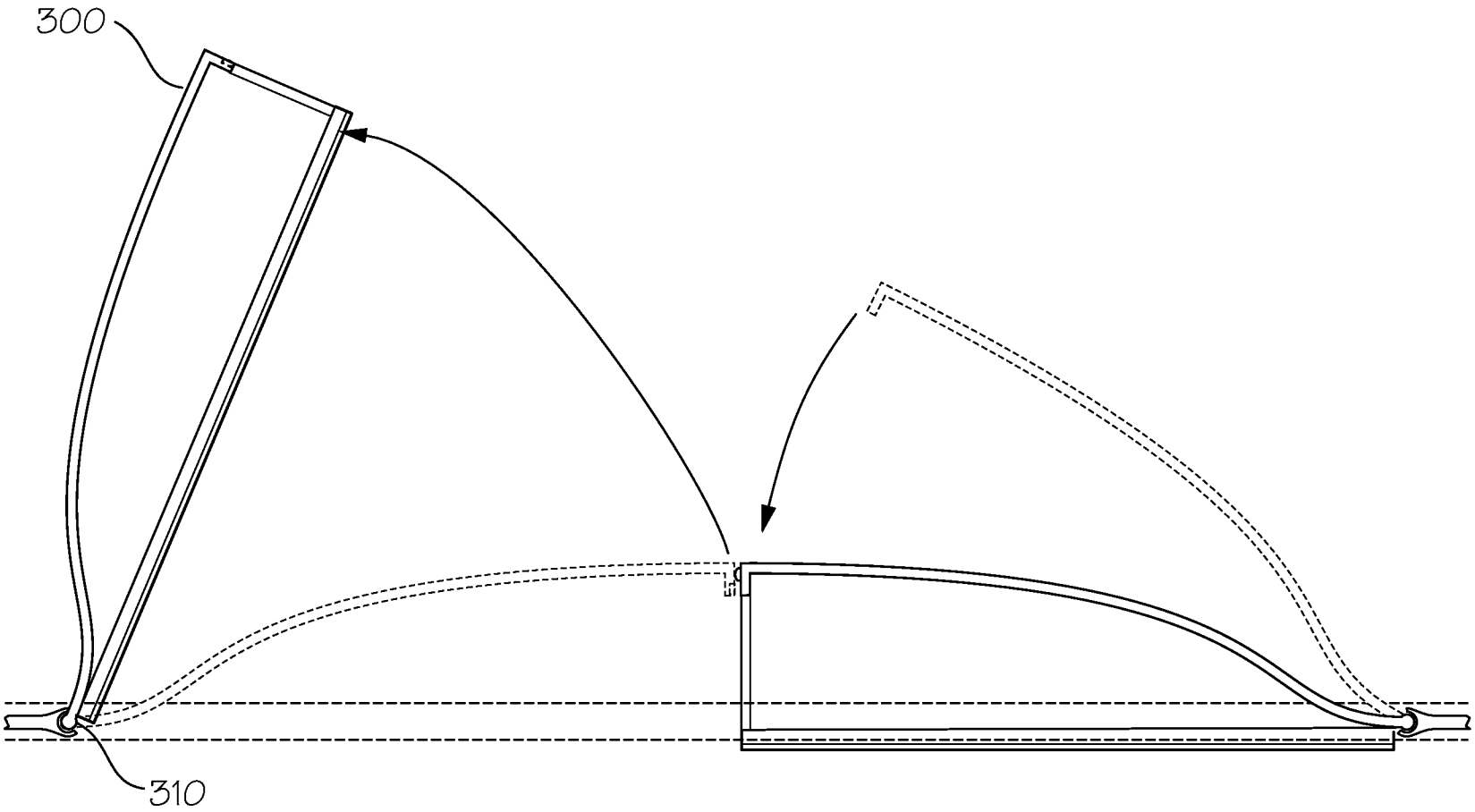
FIG. 4 shows a top plan view of one embodiment of the present invention with one of the doors in the open position and one of the doors in the closed position.

As shown in FIG. 1 the preferred embodiment of a shower door assembly with integral directional draining system 10A having a shower door frame assembly 100 comprising of a frame body 110 defining a horizontal drain channel 120 and a plurality of drain holes 130; at least one side panel 200 comprising of a first end 210A and a second end 210B, the first end 210A of the side panel being sized and configured to be fixedly attached to the frame body 110 and the second end 210B of the side panel further comprising of a hinge mount 220; and at least one door 300 defining a hinge mount 310 rotatably connected to the hinge mount 220 of the side panel and a door drain channel 320. The door 300 has an upper portion 330A and lower portion 330B. It is envisioned that the door frame assembly 100 will be composed of a metallic compound or a substance with similar properties known in the art. It is further envisioned that the door 300 will be composed of a glass or plastic compound or substance with similar properties known in the art.

It is envisioned that door drain channel 320 is sized and positioned so to direct shower water from the door 300 to the horizontal drain channel 120 of the door frame assembly 100.

It is further envisioned that the drain body of the horizontal drain channel 120 comprises of a vertical lip 115 sized, configured, and positioned to direct shower water towards the plurality of drain holes 130.

As seen in FIGS. 7-8B, the hinge mount 220 of the side panel 200 comprises of a vertical demi-cylindrical channel 230 further comprising a plurality of horizontal door mounting channels 240 sized and configured to receive a mounting head 340.

The hinge mount 310 comprises of a mounting head 340 sized and configured to engage the horizontal door mounting channel 240 of the side panel 200 as illustrated in FIGS. 7 and 8B.

In order to provide maximum bathing space, it is envisioned that the door 300 will be designed to flare upward and bow outward such that the upper portion 330A of the door 300 is farther away from the shower door frame 100 than the lower portion 330B of the door 300.

Figures 5, 6:
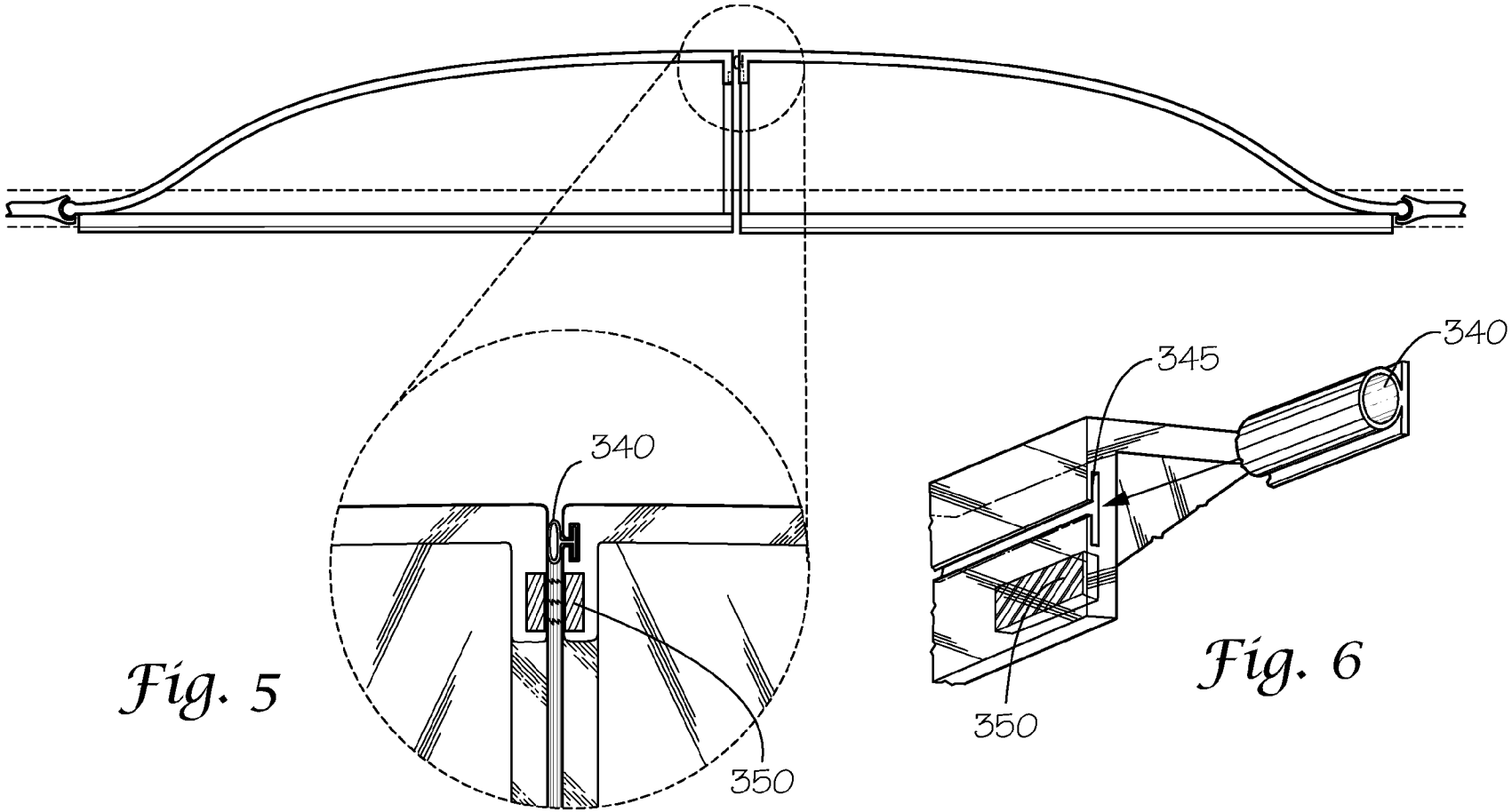
FIG. 5 shows a top plan view of one embodiment of the present invention with both doors in the closed position and close up view of the earth magnets and sealing gasket forming a water tight seal when the doors are in a closed position.
FIG. 6 shows a close up view of how the sealing gasket and earth magnet are configured in the shower door.

As depicted in FIGS. 5 and 6 the door 300 further comprises of sealing gasket 340 and at least one earth magnet 350 sized and configured such that when the door 300 is in a closed position (See FIG. 5), the gasket 340 forms a water tight seal and the at least one earth magnet 350 secures the door 300 in the closed position. It is envisioned that sealing gasket 340 will be removably inserted into a channel 345 in the door 300, so that the sealing gasket 340 may be replaced if it becomes nonfunctional. It is envisioned that the sealing gasket 340 will be composed of a rubber polymer or other elastic material with similar properties known in the art.

Figure 9A:
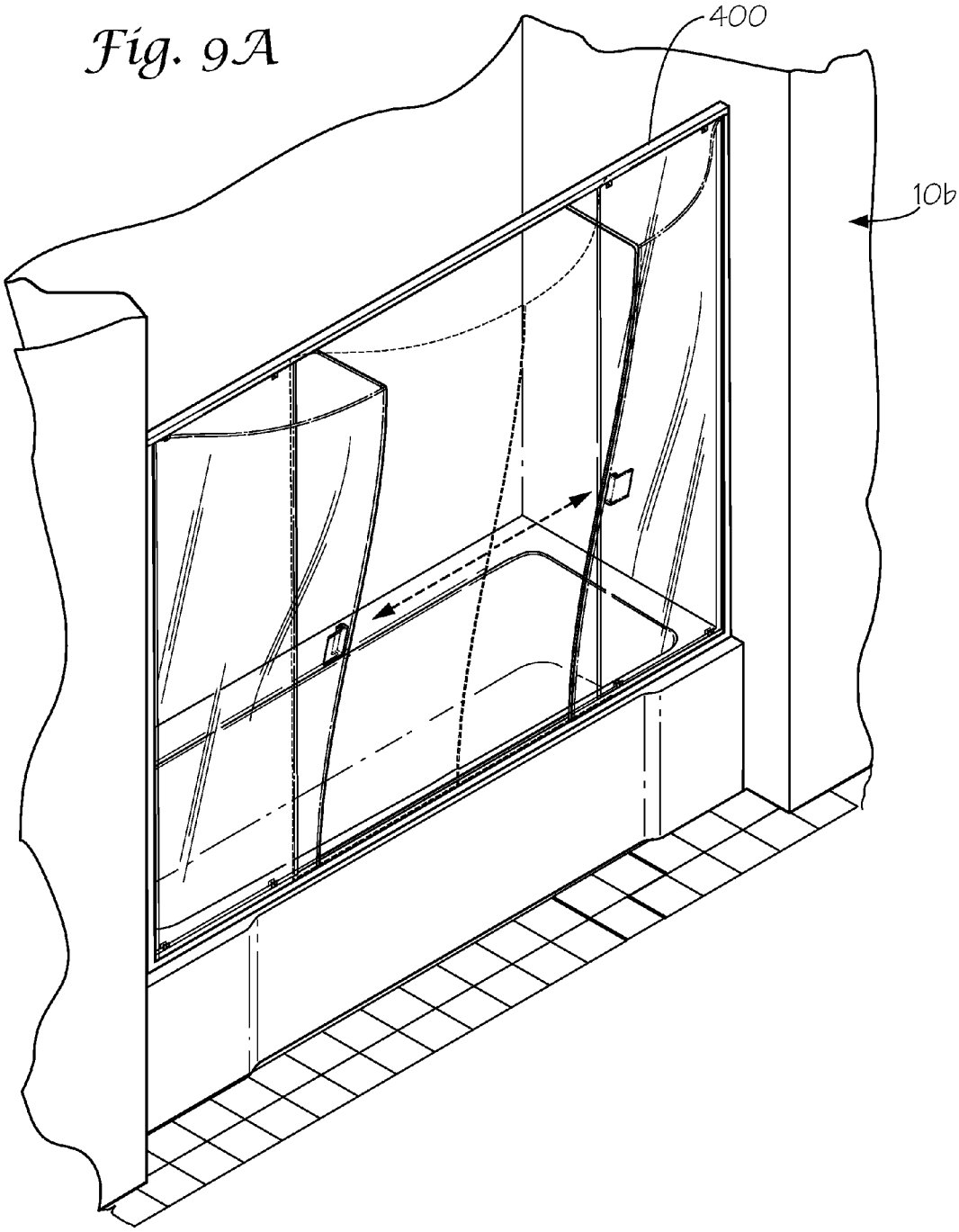
FIG. 9A shows one embodiment of the present invention with sliding doors instead of the hinge assembly where both sliding doors are slid into the open position.
Figure 9B:
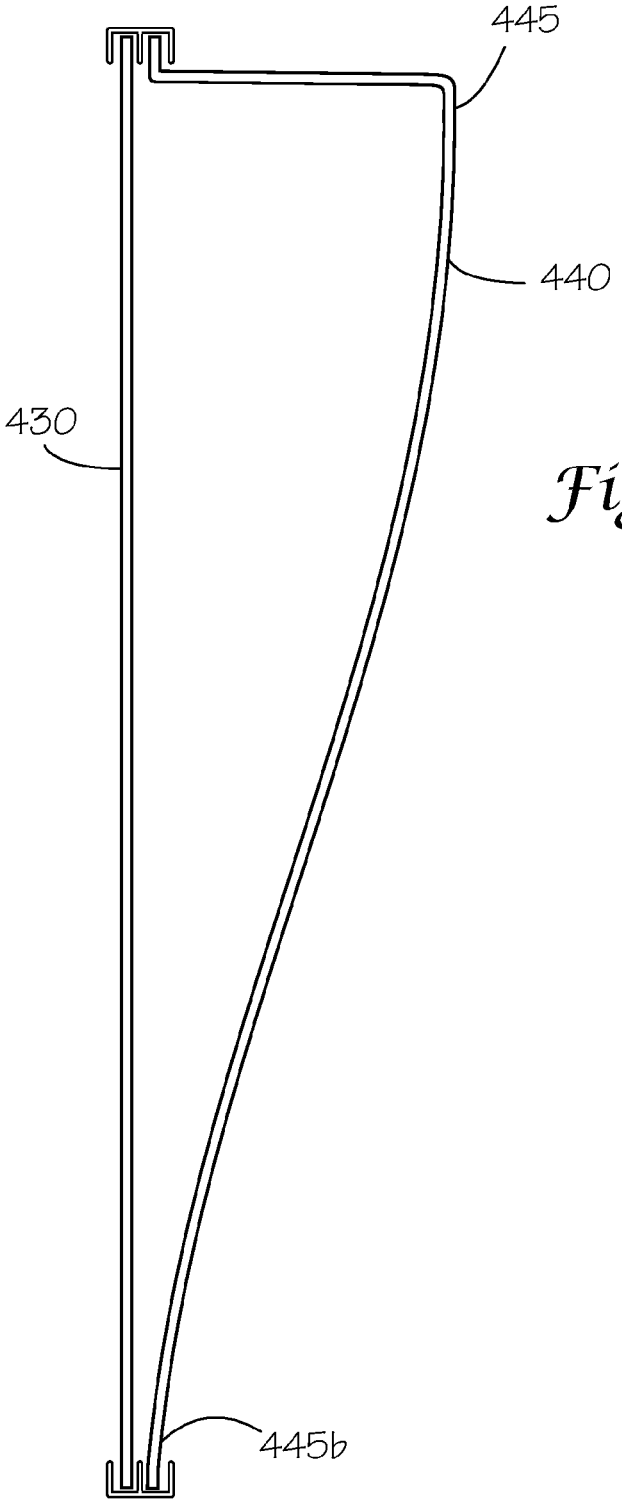
FIG. 9B shows a cross section view of the sliding door embodiment of the present invention.
Figure 10:
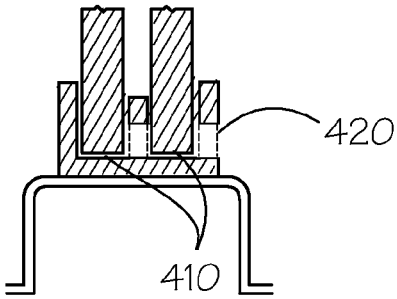
FIG. 10 shows a cross section view of the door frame of one embodiment of the present invention with track channels, the sliding door, and a side panel in view.

In an alternate embodiment of the present invention 10B as depicted in FIGS. 9A-10, the shower door frame assembly 10B comprises of a frame body 400 defining at least two track channels 410 and a plurality of drain holes 420; at least one side panel 430 sized and configured to be fixedly attached within one of the track channels 410 of the frame body 400; and at least one door 440, having an upper portion 445A and a lower portion 445B slidably mounted to one of the track channels 410 of the frame body 400. It is envisioned that the door frame body 400 will be composed of a metallic compound or a substance with similar properties known in the art. It is further envisioned that the door 440 will be composed of a glass or plastic compound or substance with similar properties known in the art In order to provide maximum bathing space, it is envisioned that the door 440 will be designed to flare upward and bow outward such that the upper portion 445A of the door 440 is farther away from the shower door frame 400 than the lower portion 445B of the door 440.

Figure 11:
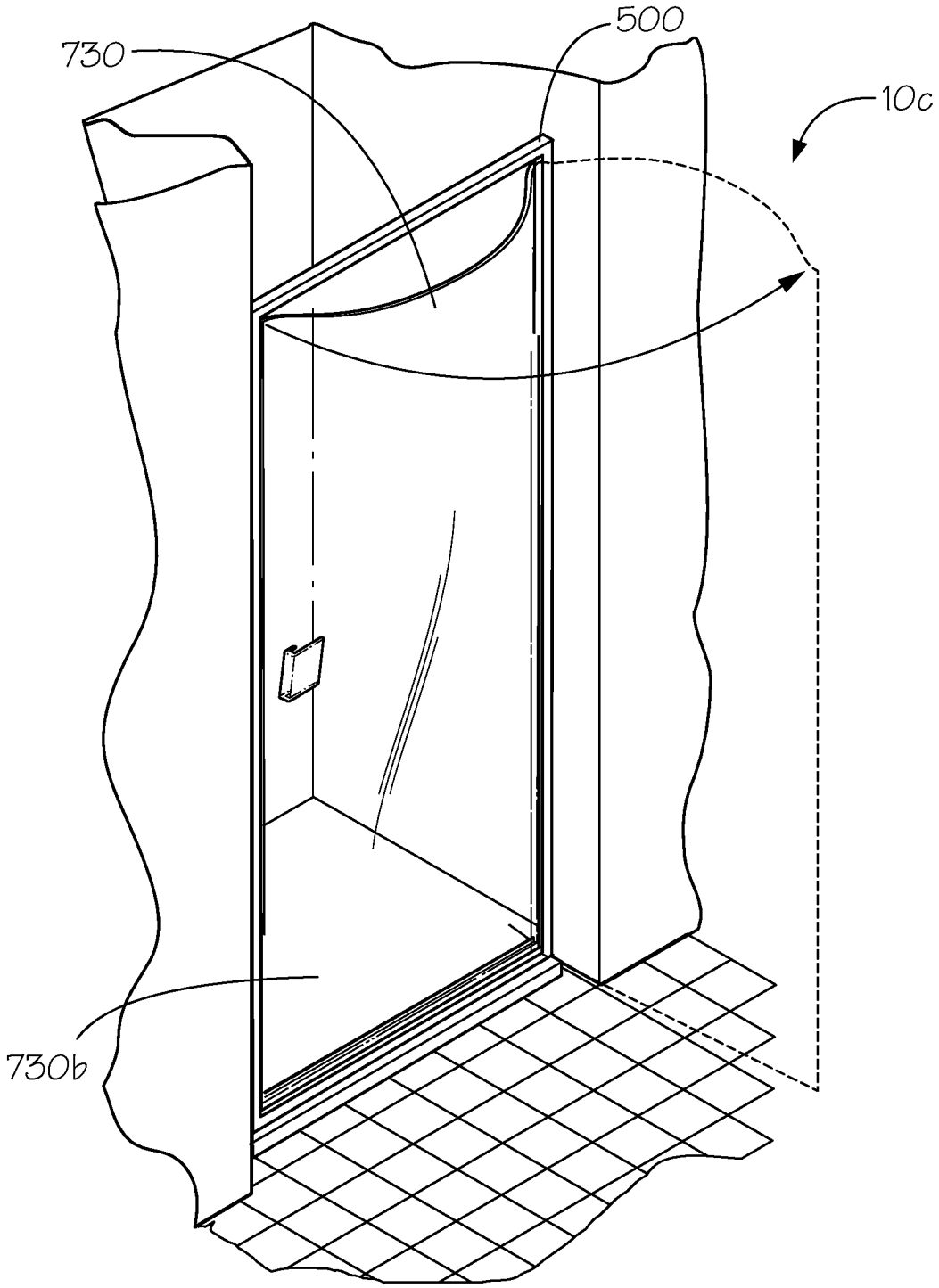
FIG. 11 shows a perspective view of one embodiment of the present invention with a single swinging door configuration.
Figure 12:
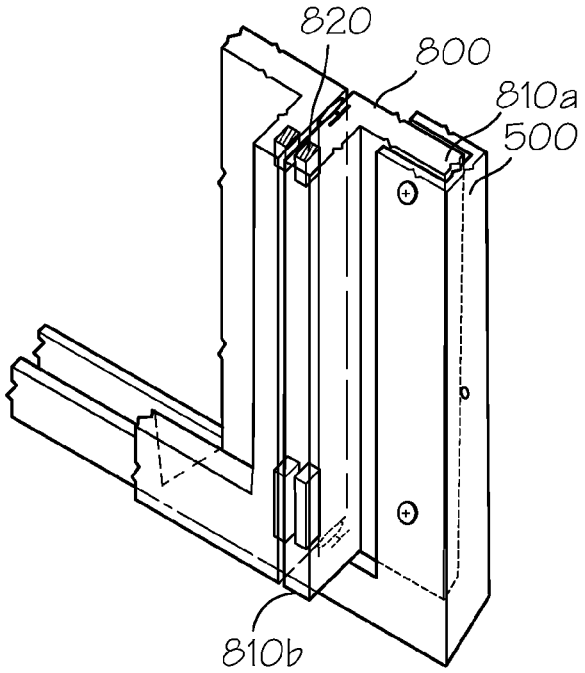
FIG. 12 shows a cut away view of the door and side panel of the single swinging door configuration of the present invention with the door in the closed position and held in place by earth magnets.
Figure 13:
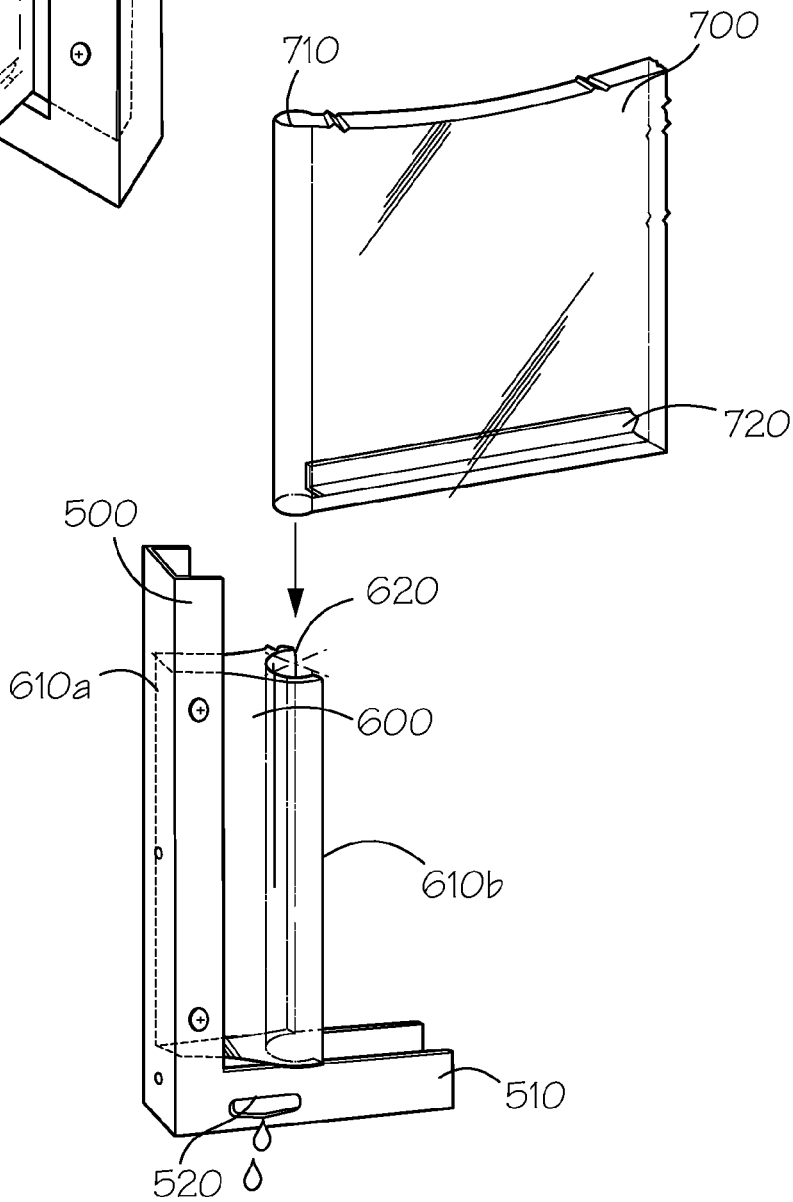
FIG. 13 shows an exploded view of the hinge assembly of the single swinging door embodiment of the present invention comprising the hinge mount of the side panel and the mounting head of the door.

In a second alternate embodiment of the present invention 10C as depicted in FIGS. 11-13, the shower door assembly 10C comprises of a frame body 500 defining a horizontal drain channel 510 and a plurality of drain holes 520; at least one side panel 600 comprising of a first end 610A and a second end 610B, the first end 610A of the side panel 600 being sized and configured to be fixedly attached to the frame body 500 and the second end 610B of the side panel 600 further comprising of a hinge mount 620; a single door 700 defining a hinge mount 710 rotatably connected to the hinge mount 620 of the side panel 600 and a door drain channel 720. The door 700 has an upper portion 730A and lower portion 730B; and a second side panel 800, having a first end 810A and a second end 810B, the first end 810A being sized and configured to be fixedly attached to the frame body 500 and the second end 810B of the second side panel 800 further comprising of at least one earth magnet 820 sized and configured such that when the door 700 is in a closed position, the at least one earth magnet 820 secures the door 700 in the closed position. It is envisioned that the door frame body 500 will be composed of a metallic compound or a substance with similar properties known in the art. It is further envisioned that the door 700 will be composed of a glass or plastic compound or substance with similar properties known in the art.

In order to provide maximum bathing space, it is envisioned that the door 700 will be designed to flare upward and bow outward such that the upper portion 730A of the door 700 is farther away from the shower door frame 500 than the lower portion 730B of the door 700.

In operation, it is envisioned that shower water will contact the shower door 300, 440, or 700 and be pulled downward by gravity to the door drain channel 320, 720, and travel through the horizontal drain channel 120,410, or 510 of the frame body 110, 400, or 500, and eventually out through the plurality of drain holes 130, 420, or 520 and into the basin of a bathtub or the interior of a shower. By directing the shower water in such a manner, the amount of water dripping on the floor of the bathroom will be greatly reduced and therefore create a safer bathing experience.

An advantage of the present invention is that it provides a shower door assembly with an integral directional draining system that directs shower water into the interior of a bathtub or shower.

Another advantage of the present invention is that it provides a shower door assembly that increases the interior bathing area of a bathtub or shower.

Another advantage of the present invention is to provide a shower door assembly that forms a water tight seal when the door is in a closed position.

Yet another advantage of the present invention is that it provides a shower door assembly that includes a mechanism to keep the door in a closed position.

Although the present invention has been described in considerable detail with reference to certain preferred versions thereof, other versions are possible. Therefore, the spirit and scope of the claims should not be limited to the description of the preferred versions contained herein.

What is claimed is:

1. A shower door assembly with integral directional draining system comprising:

a shower door frame assembly comprising of a frame body defining a drain body having a horizontal drain channel and a plurality of drain holes;

at least one side panel comprising of a first end and a second end, the first end of the side panel being sized and configured to be fixedly attached to the frame body and the second end of the side panel further comprising of a hinge mount; and at least one door defining a hinge mount rotatably connected to the hinge mount of the side panel and a door drain channel, the door comprising of an upper portion and lower portion.

2. The shower door assembly of claim 1 wherein the drain body of the horizontal drain channel comprises of a vertical lip sized, configured and positioned to direct shower water towards the plurality of drain holes.

3. The shower door assembly of claim 2 wherein the hinge mount of the side panel comprises of a vertical demi-cylindrical channel further comprising a plurality of horizontal door mounting channels sized and configured to receive a mounting head.

4. The shower door assembly of claim 3 wherein the hinge mount comprises of a mounting head sized and configured to engage the horizontal door mounting channel of the side panel.

5. The shower door assembly of claim 1 wherein the door flares upward and bows outward such that the upper portion of the door is farther away from the shower door frame than the lower portion of the door.

6. The shower door assembly of claim 1 wherein the door further comprises of sealing gasket and at least one earth magnet sized and configured such that when the door is in a closed position, the gasket forms a water tight seal and the at least one earth magnet secures the door in the closed position.

7. A shower door assembly with integral directional draining system comprising:

a shower door frame assembly comprising of a frame body defining a horizontal drain channel and a plurality of drain holes;

at least one side panel comprising of a first end and a second end, the first end of the side panel being sized and configured to be fixedly attached to the frame body and the second end of the side panel further comprising of a hinge mount;

a single door having a first end and second end least one door defining a hinge mount rotatably connected to the shower door frame and a door drain channel, the door further comprising of an upper portion and lower portion; and a second side panel, having a first end and a second end, the first end being sized and configured to be fixedly attached to the frame body and the second end of the second side panel further comprising of at least one earth magnet sized and configured such that when the door is in a closed position, the at least one earth magnet secures the door in the closed position.

8. The shower door assembly of claim 7 wherein the door flares upward and bows outward such that the upper portion of the door is farther away from the shower door frame than the lower portion of the door.

* * * * *